US009782055B2

(12) United States Patent
Williamson

(10) Patent No.: US 9,782,055 B2
(45) Date of Patent: Oct. 10, 2017

(54) CLEANING DEVICE

(71) Applicant: Peter John P. Williamson, Tottenham (CA)

(72) Inventor: Peter John P. Williamson, Tottenham (CA)

(73) Assignee: Peter John P. Williamson, Tottenham, Ontario (CA)

( * ) Notice: Subject to any disclaimer, the term of this patent is extended or adjusted under 35 U.S.C. 154(b) by 81 days.

(21) Appl. No.: 15/005,056

(22) Filed: Jan. 25, 2016

(65) Prior Publication Data

US 2016/0213223 A1 Jul. 28, 2016

Related U.S. Application Data

(60) Provisional application No. 62/106,884, filed on Jan. 23, 2015.

(51) Int. Cl.

| | |
|---|---|
| ***A47L 25/00*** | (2006.01) |
| ***A47L 13/42*** | (2006.01) |
| ***A47L 13/10*** | (2006.01) |
| *B08B 7/00* | (2006.01) |
| *A47L 13/20* | (2006.01) |

(52) U.S. Cl.

CPC ..... *A47L 25/005* (2013.01); *A47L 13/10* (2013.01); *A47L 13/42* (2013.01); *A47L 13/20* (2013.01); *B08B 7/0028* (2013.01)

(58) Field of Classification Search

CPC ..... A47L 25/005; A47L 25/08; A47L 13/20; A47L 13/24; A47L 11/4047; B08B 11/4047

USPC ..... 15/104.002, 99, 228, 231

See application file for complete search history.

(56) References Cited

U.S. PATENT DOCUMENTS

| | | | | | |
|---|---|---|---|---|---|
| 899,726 | A * | 9/1908 | Goodier | A47L 13/20 | 15/228 |
| 1,130,064 | A * | 3/1915 | Buchanan | A47L 13/20 | 15/228 |
| 2,452,744 | A * | 11/1948 | Gardner | A47L 11/08 | 15/228 |
| 2,690,582 | A * | 10/1954 | Sundell | A47L 11/085 | 15/118 |
| 6,032,318 | A * | 3/2000 | McLaughlin | A47L 13/29 | 15/228 |
| 6,904,638 | B2 * | 6/2005 | Flynn | A47L 13/24 | 15/228 |

(Continued)

*Primary Examiner* — Laura C Guidotti

(74) *Attorney, Agent, or Firm* — Dinsmore & Shohl LLP

(57) ABSTRACT

A cleaning device having a frame and an elongated strip of cleaning material wound into a roll rotatably mounted on a roller support. A slave roller having a core and a cylindrical tube disposed over the core is mounted to the frame so that the slave roller is spaced and parallel to the roll. A torsion spring is secured to and between the core and the tube so that, as the tube rotates relative to the core, the spring is wound. The strip of cleaning material is wound in between the roll and slave roller so that, upon rotation of the first roller in a first rotational direction, the cleaning material is unwound from the slave roller onto the roll while simultaneously winding the torsion spring. Upon disengagement of the first roller from the cleaning surface, the torsion spring rotatably drives the slave roller and rewinds the portion of the strip around the tube.

9 Claims, 3 Drawing Sheets

(56) References Cited

U.S. PATENT DOCUMENTS 7,793,377 B2 * 9/2010 Knopow ..... A47L 25/005
15/104.002

* cited by examiner

CLEANING DEVICE

CROSS-REFERENCE TO RELATED APPLICATIONS

This application claims priority of U.S. Provisional Application 62/106,884 filed Jan. 23, 2015, the contents of which are incorporated herein by reference.

BACKGROUND OF THE INVENTION

I. Field of the Invention

The present invention relates generally to cleaning devices and, more particularly, to a floor cleaning device utilizing an elongated strip of adhesive or other cleaning material to remove detritus from a surface.

II. Description of Related Art

There are many previously known cleaning devices which utilize an elongated strip of a cleaning material, such as an adhesive strip. Such cleaning devices typically include an elongated strip of the cleaning material which is wound into a roll with the cleaning side, such as the adhesive side, of the strip facing outwardly.

Such cleaners are oftentimes used, for example, as lint rollers. For the lint roller, the strip is wound on a handle of some sort and the adhesive strip is then rolled along the surface to be cleaned. When the adhesive contacts detritus, such as pet hair, dandruff, and the like, the detritus adheres to the cleaning material. After a period of time, however, the cleaning material on the exposed roll becomes spent and no longer effectively removes detritus from the surface being cleaned. When this occurs, a portion of the strip is removed from the roll thus exposing fresh cleaning material. This process is then repeated until the entire roll is consumed.

Although such rollers with elongated strips of cleaning material have been used for lint rollers, such cleaning rolls are also used to clean a floor or other flat surface. In this case, the handle is elongated with the adhesive roll rotatably mounted at one end of the handle and typically with the axis of the handle perpendicular to the axis of the roll. The person cleaning the floor surface then rolls the cleaning roll along the floor so that the cleaning material removes detritus, such as pet hair, as well as other debris from the floor surface. As with the lint roller, however, the cleaning material becomes exhausted or spent after extended use so that the roll no longer effectively removes detritus and other debris from the floor surface. When this occurs, it is necessary to tear off or remove a portion of the strip from the roll to expose new cleaning material. This process then continues until the entire adhesive roll is consumed.

One disadvantage of these previously known cleaners for floor surfaces, however, is that the debris on the floor surface is oftentimes unsanitary. For that reason, many users are hesitant to handle the adhesive roll when it is necessary to tear off or remove a portion of the strip from the roll to expose fresh cleaning material. Furthermore, the debris from the floor surface also hides the starting point of the next layer of the roll to be removed and longer pet hair can overlap the seam and make it difficult to remove the spent portion of the cleaning strip.

For the above reasons, such cleaning rolls for floor surfaces have not enjoyed widespread use or success.

SUMMARY OF THE PRESENT INVENTION

The present invention provides a cleaning device using an elongated strip of cleaning material that is wound about a roll for floor surfaces as well as other generally flat surfaces which overcomes the above-mentioned disadvantages of the previously known cleaning devices.

In brief, the cleaning device of the present invention comprises a frame having a roller support. An elongated strip of cleaning material is wound into a roll and that roll is rotatably mounted on the roller support.

A slave roller is also provided having both a core and a cylindrical tube disposed over and rotatable relative to the core. The core is selectively mounted against rotation to the frame so that the roll and slave roller are spaced apart and parallel to each other. A portion of the strip of cleaning material from the roll is wound around the tube of the slave roller.

A torsion spring is secured to and between the core and the tube. Consequently, rotation of the roll in a first rotational direction unwinds the portion of the strip from the slave roller onto the roll and simultaneously winds the torsion spring. Consequently, the portion of the cleaning material that is unwound from the slave roller and onto the roll contacts the floor or other surface and removes detritus, debris, etc. However, upon release of the roll from the surface being cleaned, the torsion spring rotatably drives the slave roller and rewinds the portion of the strip around the tube of the slave roller.

After repeatedly rolling the roll over the floor, the portion of the cleaning material wound onto the slave roller tube becomes spent. When this occurs, the user manually rotates the tube and core using a handle. In doing so, fresh cleaning material is wound about the tube of the slave roller. The core is then again locked against rotation relative to the frame and the above process is repeated until the entire roll of cleaning material is spent.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
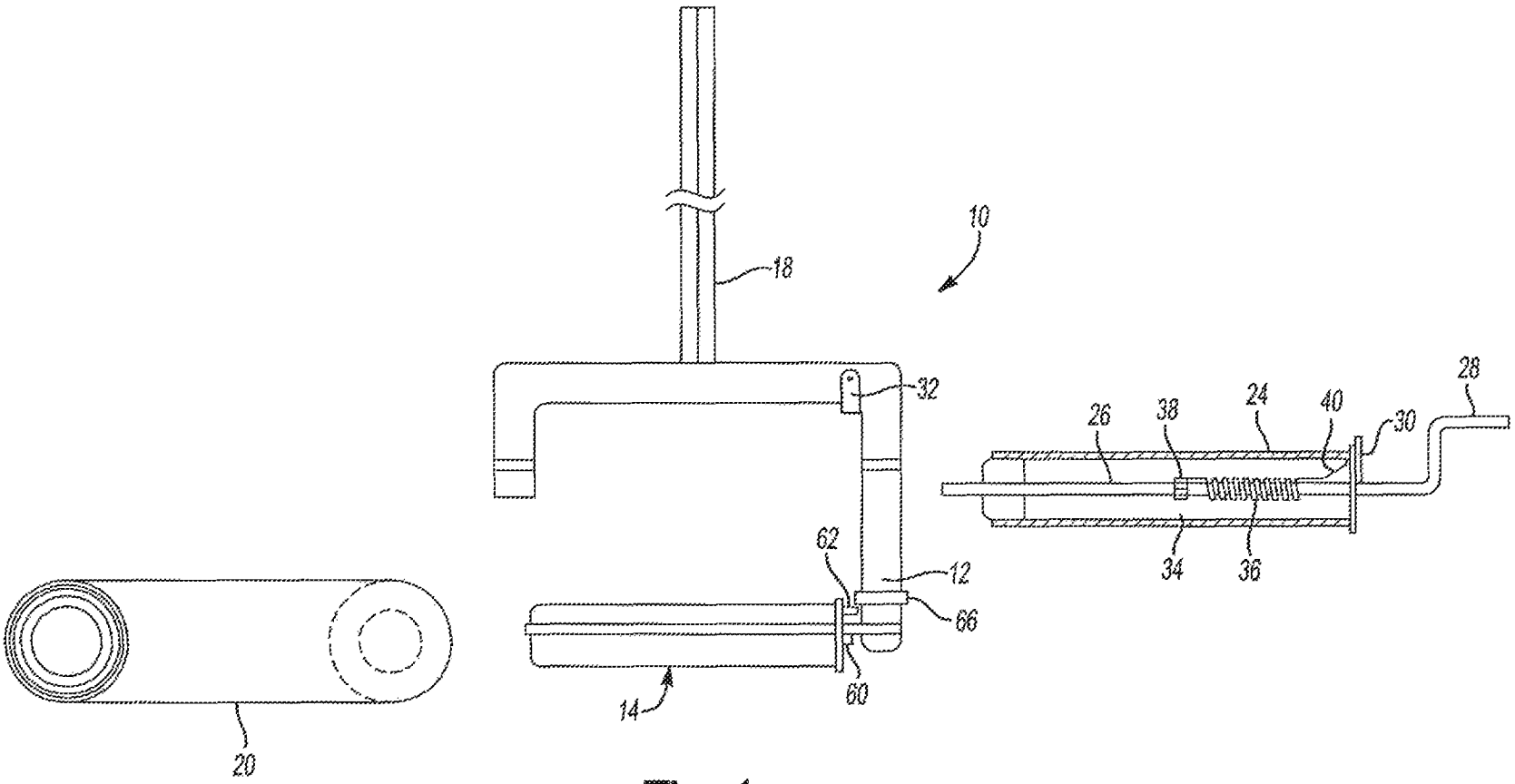
FIG. 1 is an exploded plan view illustrating a preferred embodiment of the present invention.
Figure 2:
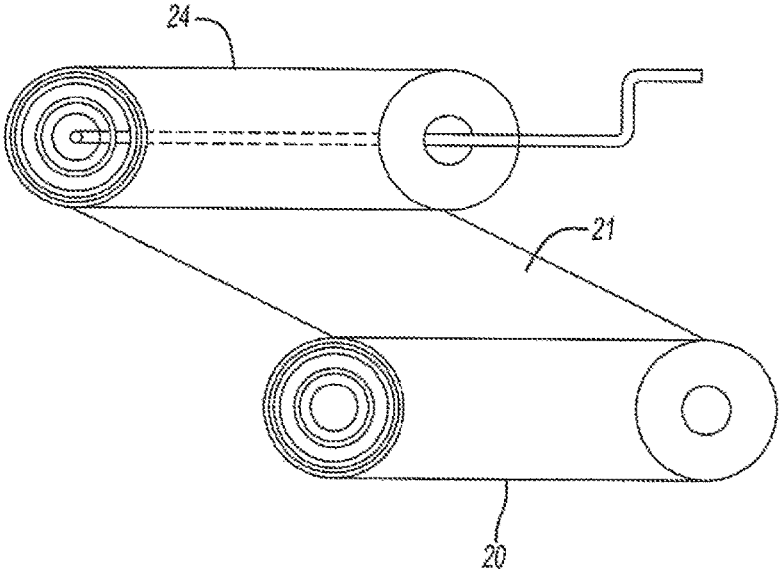
FIG. 2 is an elevational view with parts removed.
Figure 4:
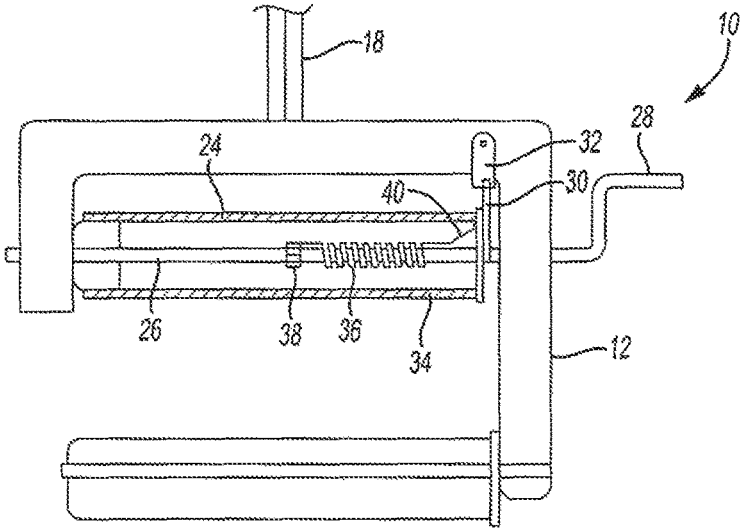
FIG. 4 is a plan view in partial cross section.

With reference first to FIGS. 1, 2, and 4, a cleaning device 10 according to the present invention is shown. The cleaning device 10 includes an L-shaped frame 12 having a roller support 14 rotatably mounted to the frame 12. In addition, an elongated handle 18 extends outwardly from the frame 12 in a direction generally perpendicular to the axis of the roller support 14.

A roll 20 of cleaning material 21 is rotatably mounted to the roller support 14 by any conventional fashion, such as a friction fit. This roll 20 of cleaning material 21 may comprise, for example, an elongated strip of backing material with the outwardly facing side of the strip coated with an adhesive material. Other types of cleaning material, however, may alternatively be used. For example, the cleaning material 21 may be constructed from an elongated strip of backing material covered on one side with a liquid or damp cleaning material. Furthermore, with the roll 20 mounted to the first roller support 14, the roll 20 is free to rotate on the frame 12. Other mechanisms may also be used to secure the roll 20 to the roller support 14 without deviation from the spirit or scope of the invention.

Referring now to FIGS. 1, 2, 4, and 5, a slave roller 24 is mounted to the frame 12 so that the slave roller is spaced apart and parallel to the roller support 14. The slave roller 24 includes an elongated core 26 extending through an opening in the frame 12. This core 26 is rotatable relative to the frame 12 while a handle 28 attached to one end of the core 26 facilitates rotation of the core 26.

However, as best shown in FIGS. 1 and 4, to temporarily or selectively lock the core 26 against rotation to the frame 12, a lock pin 30 is secured to and extends radially outwardly from the core 26 adjacent one end of the core 26. This lock pin 30 abuts against a spring clip 32 mounted to the frame 12 which prevents rotation of the lock pin 30, and thus of the core 26, relative to the frame 12. However, when desired, the core 26 with its attached lock pin 30 may be manually axially displaced relative to the frame 12 and out of registration with the spring clip 32, or the clip may be pivoted away from the pin 30 to permit rotation of the core 26 relative to the frame 12 for a reason to be subsequently described.

Still referring to FIGS. 1 and 4, the slave roller 24 includes a cylindrical tube 34 which is coaxially rotatably mounted around the core 26. A torsion spring 36 is then secured at one end 38 to the core 26 and at its other end 40 to the tube 34. Consequently, as the tube 34 rotates relative to the core 26, the torsion spring 36 is wound to a greater tension. Once the winding pressure on the tube 34 is released, however, the torsion spring will rewind the tube 34 in the opposite direction due to the force of the torsion spring.

Figure 5:
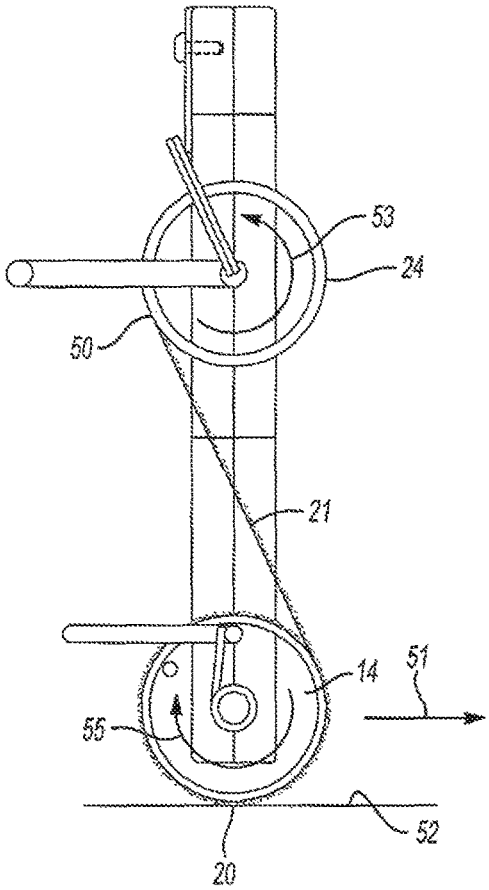
FIG. 5 is a side view of the cleaning device.

As best shown in FIG. 5, with the roll of cleaning material 20 rotatably mounted to the first roller support 16, a portion 50 of the cleaning material 21 is unwound from the roll 20 and instead wound about the tube 34 of the slave roller 24. The slave roller 24 is then positioned so that the lock pin 30 registers with the spring clip 32 thus locking the core 26 against rotation relative to the frame 12.

As the roll 20 is pushed along a floor or other surface 52 in the direction of arrow 51, the frictional force between the roller 20 and the surface 52 rotates the roller 20 in the direction of arrow 55 and unwinds the portion 50 of cleaning material from the slave roller 24 onto the roll 20. In doing so this portion 50 contacts the ground surface 52 and removes detritus and other debris from the surface 52. Simultaneously as the roller 20 rolls along the surface 52, the tube 34 of the slave roller 24 rotates around the core 26 as shown by arrow 53 thus winding and increasing the tension of the torsion spring 36.

When the roller is subsequently lifted from the ground surface 52, the frictional engagement between the roller 20 and the surface 52 terminates. This allows the torsion spring 36 in the slave roller 24 to rewind the tube 34 thus rewinding the portion 50 of the cleaning material from the roller 20 to the slave roller 24.

Figure 3A:
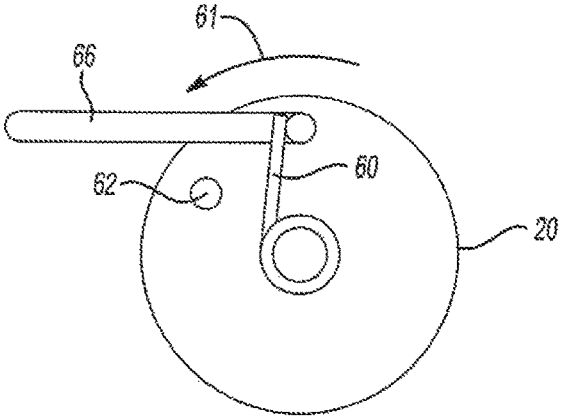
FIGS. 3A and 3B are diagrammatic views illustrating the cleaning device when moved across a surface being cleaned in a first direction.
Figure 3B:
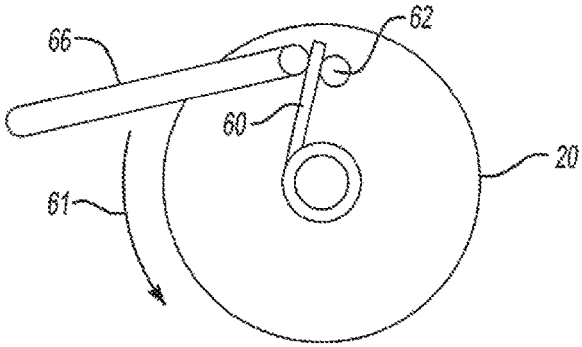

With reference now to FIGS. 3A and 3B, it is desirable to limit the number of rotations of the roll 20 on the surface 52 being cleaned to ensure that only the desired portion 50 of the cleaning material from the slave roller 24 is unwound and placed into contact with the surface 52 during a cleaning operation. Consequently, a swing bar 60 is rotatably mounted to the roll 20. This swing bar 60 is dimensioned so that it can abut both against a catch pin 62 secured to and protruding axially outwardly from an end 64 of the roll 20 as well as a swing bar lock 66 movably attached to the frame 12.

Consequently, with the swing bar 60 and catch pin 62 at the position shown in FIG. 3A, after one full rotation of the roll 20 in the direction of arrow 61, the catch pin 62 abuts against the swing bar 60. A second full rotation of the roll can occur with both the pin and swing bar rotating with the roll 20. This rotation continues until the swing bar abuts against the swing bar lock 66 as shown in FIG. 3B. In this fashion, the roll 20 is only allowed to rotate substantially two full rotations during a cleaning operation before further rotation of the roll is prohibited. However, additional rotations of the roll 20 can occur, for example when the portion 50 of cleaning material is being replaced with a fresh portion, by sliding the swing bar lock 66 on the frame 12 out of engagement with the swing bar 60. The swing bar 66 is then replaced to its operational position to limit the rotations of the roll to substantially two rotations during a cleaning operation.

In a cleaning operation, the roll 20 is moved across the surface 52 to be cleaned. After a period of time, however, the portion 50 of the cleaning material will become spent and thus ineffective in removing debris from the surface 52. When this occurs, the swing bar lock 66 is slid on the frame 12 out of registration with the swing bar 60. The core 26 on the slave roll 24 or clip 32 is then moved so that the lock pin 30 no longer registers with the spring clip 32 and the handle 28 is manually rotated to unwind a sheet of fresh adhesive material from the roll 20 and rewind that portion around the slave roller 24. The core 26 is then repositioned in its operative position so that the spring clip 32 and lock pin 30 register with each other and, likewise, the swing bar lock is repositioned on the frame 12 so that it again registers with the swing bar 60. Thereafter, the entire cleaning operation may be repeated.

From the foregoing, it can be seen that the present invention provides a simple yet effective cleaning device which utilizes an elongated strip of cleaning material to remove detritus and debris. Having described my invention, however, many modifications thereto will become apparent to those skilled in the art to which it pertains without deviation from the spirit of the invention as defined by the scope of the appended claims.

I claim:

1. A cleaning device comprising:

a frame having a roller support, an elongated strip of a cleaning material wound into a roll and rotatably mounted on said roller support, a slave roller having a core and a cylindrical tube disposed over said core, said core being selectively mounted against rotation so that said slave roller is spaced apart and parallel to said roll and a portion of said strip of cleaning material from said roll being wound around said tube of said slave roller, a torsion spring secured to and between said core and said tube, wherein rotation of said roll in a first rotational direction during contact with a surface winds said portion of said strip around said roll and simultaneously winds said torsion spring so that, upon disengagement of said roll from said surface, said torsion spring rotatably drives said slave roller and rewinds said portion of said strip around said tube.

2. The cleaning device defined in claim 1 wherein said cleaning material comprises an adhesive roll.

3. The cleaning device defined in claim 1 and comprising a lock pin secured to and extending outwardly from said core of said slave roller, said lock pin registering with a spring clip mounted to said frame which prevents rotation of said core.

4. The cleaning device defined in claim 3 and comprising a handle mounted to said core which enables rotation of said core on said frame by deflecting said spring clip.

5. The cleaning device defined in claim 1 and comprising a clutch operatively coupled between said roll and said frame which permits limited rotation of said roll on said frame.

6. The cleaning device defined in claim 5 wherein said clutch permits only two rotations of said roll on said frame.

7. The cleaning device defined in claim 6 wherein said clutch comprises:

a swing bar coaxially rotatably mounted to said first roller support, a pin mounted to said first roll, said pin extending longitudinally outward from said roll so that said pin contacts said swing bar during a full rotation of said roll, and a swing bar lock mounted to said frame which abuts against said swing bar at a predetermined rotational position of said roll.

8. The cleaning device defined in claim 1 wherein said cleaning material comprises an absorbent material.

9. The cleaning device defined in claim 1 wherein said roll comprises a roll support and said strip of cleaning material wound around said roll support.

* * * * *